US008931655B2

(12) United States Patent
Stone

(10) Patent No.: US 8,931,655 B2
(45) Date of Patent: Jan. 13, 2015

(54) BIN LID AND BIN INCORPORATING SAME

(76) Inventor: Warren Leonard Stone, Heath Hill (AU)

( * ) Notice: Subject to any disclaimer, the term of this patent is extended or adjusted under 35 U.S.C. 154(b) by 0 days.

(21) Appl. No.: 13/639,340

(22) PCT Filed: Apr. 5, 2011

(86) PCT No.: PCT/AU2011/000388

§ 371 (c)(1),
(2), (4) Date: Oct. 4, 2012

(87) PCT Pub. No.: WO2011/123887

PCT Pub. Date: Oct. 13, 2011

(65) Prior Publication Data

US 2013/0026166 A1 Jan. 31, 2013

(30) Foreign Application Priority Data

Apr. 7, 2010 (AU) ..... 2010901476
Dec. 1, 2010 (AU) ..... 2010905296

(51) Int. Cl.

| | |
|---|---|
| ***B65D 41/56*** | (2006.01) |
| ***B65D 51/00*** | (2006.01) |
| ***B65D 43/12*** | (2006.01) |
| ***B65D 43/20*** | (2006.01) |
| ***B65F 1/14*** | (2006.01) |

(52) U.S. Cl.
CPC ..... *B65F 1/1607* (2013.01)
USPC ..... 220/212; 220/345.1

(58) Field of Classification Search
CPC ..... B65D 43/14; B65D 43/20; B65D 88/02; B65D 90/00; B65B 7/28
USPC ..... 220/254.2, 812, 87.2, 87.1; 49/324, 339
See application file for complete search history.

(56) References Cited

U.S. PATENT DOCUMENTS

| | | | | |
|---|---|---|---|---|
| 2,238,630 | A * | 4/1941 | De Reamer | 200/61.82 |
| 2,434,238 | A * | 1/1948 | Wolfson | 220/87.2 |
| 3,687,328 | A * | 8/1972 | Spruyt et al. | 220/324 |
| 4,162,024 | A * | 7/1979 | Shanley | 220/350 |
| 4,456,141 | A * | 6/1984 | Pamment | 220/254.5 |
| 4,609,117 | A * | 9/1986 | Pamment | 220/252 |
| 4,620,644 | A * | 11/1986 | Miller | 220/826 |
| 4,878,596 | A * | 11/1989 | Cawley et al. | 220/812 |
| 4,902,482 | A * | 2/1990 | Faust | 422/121 |
| 5,203,664 | A * | 4/1993 | Jensen | 414/407 |

(Continued)

FOREIGN PATENT DOCUMENTS

| | | | |
|---|---|---|---|
| EP | 658679 | B1 * | 5/1997 |
| GB | 2371229 | B | 8/2004 |
| GB | 2371229 | B * | 8/2004 |

*Primary Examiner* — Anthony Stashick
*Assistant Examiner* — Jennifer N Zettl
(74) *Attorney, Agent, or Firm* — Birch, Stewart, Kolasch & Birch, LLP

(57) ABSTRACT

There is disclosed a lid for a bin, particularly a front-lift bin, the lid being configured for engagement, at an end thereof, with an open-topped receptacle of the bin whereby the lid is pivotable between an open position in which it is substantially clear of the open top to permit emptying of the bin by inversion of the bin, and a closed position, in which it covers the open top, the lid further comprising a closure which is movable across an opening defined through the lid, between an open condition, in which it permits waste to be placed into the receptacle through the opening at the end, and a closed condition, in which it covers the opening. There is also disclosed a bin incorporating the lid.

12 Claims, 17 Drawing Sheets

(56) References Cited

U.S. PATENT DOCUMENTS 5,490,606 A * 2/1996 Lombardo ..... 220/324
6,296,132 B1 * 10/2001 Pickler ..... 220/1.5
8,210,383 B1 * 7/2012 Devita ..... 220/315
2006/0006177 A1 * 1/2006 Clark et al. ..... 220/200

* cited by examiner

BIN LID AND BIN INCORPORATING SAME

This application is the National Stage under 35 U.S.C. §371 of International Application PCT/AU2011/000388 filed on Apr. 5, 2011, which claims priority under 35 U.S.C. §119 (a)-(d) of Application Number 2010901476 filed in Australia on Apr. 7, 2010, and Application No. 2010905296 filed in Australia on Dec. 1, 2010.

FIELD OF THE INVENTION

The present invention relates to a lid for use in a bin, typically for refuse, which is invertible to be emptied of its contents, and to a bin incorporating such a lid. The invention has particular, though not necessarily exclusive, application to front-lift bins.

BACKGROUND

Front-lift bins are large waste receptacles which are generally provided with hinged lids and designed to be emptied into garbage trucks. Such bins may also be referred to as "front loader containers" and "dumpsters" (the latter term being a typical reference in the United States).

A conventional front-lift bin, which can be seen in FIGS. 1A and 1B, generally comprises a large steel open-topped receptacle A, a lid B which is hingedly mounted to the top of the receptacle A at one side to be pivotally moveable between open and closed positions, and respective pockets or slots C on the lateral side walls D of the receptacle which, referring to FIG. 1C, are engageable by tines of a lifting apparatus E provided on a garbage truck F whereby the bin can be lifted off the ground and inverted such that its contents are tipped into a waste hopper on the truck.

It will be clear that the truck engages the bin from the front and lifts it through an obtuse angle, causing the lid to pivot open allowing the bin to be emptied of its contents. It is desirable that the hinged end of the lid be radially outermost in the arc which the bin follows during lifting, so that the lid will open gradually and will not swing open suddenly when the bin is tilted beyond a certain point, and will close when the bin is returned to a level orientation.

A difficulty commonly encountered with front-lift bins is that it is often necessary for people disposing rubbish into the bin to do so at an end of the bin opposite to that which the truck faces when engaging or deploying the bin, necessitating rotational reorientation of the bin, both after deployment by and before re-engagement with, the truck lifting apparatus.

This problem arises in particular in loading docks on commercial and industrial sites (like supermarkets), and creates time wastage and a risk of injury during manual repositioning of the bin, particularly when it is fully loaded.

SUMMARY OF THE INVENTION

According to a first aspect of the present invention, there is provided a lid for a bin, the lid being configured for engagement, at an end of the lid, with an open-topped receptacle of the bin whereby the lid is pivotable between an open position in which it is substantially clear of the open top to permit emptying of the bin by inversion of the bin, and a closed position, in which it covers the open top, the lid further comprising a closure which is movable across an opening defined through the lid, between an open condition, in which it permits waste to be placed into the receptacle through the opening at the end, and a closed condition, in which it covers the opening.

Preferably, the bin is a front-lift bin, dumpster and/or front loader container.

In the preferred embodiments of the invention, the lid comprises a support configured for engagement, at the end of the lid, with the receptacle, and the support is configured with said opening. The closure can be moveable, supported by and relative to the support, across the opening, between the open and closed conditions, and may thus allow and preclude, respectively, placement of rubbish into the receptacle.

Preferably, the closure is slidably moveable relative to the support to be opened or closed.

Preferably, the support comprises a pair of opposed arms configured to extend along the sides of the receptacle adjacent said top when the lid is in the closed position and being arranged to support the closure when it is closed. Preferably, the closure is slidably movable along the arms to be opened or closed.

Preferably, the closure is openable at the end.

Preferably, the lid can keep the closure open.

In a preferred embodiment of the invention, the lid further comprises biasing means arranged to bias the closure towards an open condition. Preferably, the biasing means comprises a resilient biasing mechanism such as one comprising at least one spring, which may be a torsional spring.

Preferably, the lid includes retaining means/at least one retainer for releasably retaining the closure in a closed condition. Preferably, the retaining means is operable at the end. The retaining means may comprise, for example, a lock, latch or catch.

In the preferred embodiments of the invention, the support is connectable to the receptacle via pins to be hingedly engaged with the receptacle.

Preferably, the closure comprises a mechanism operable from the end to move the closure, when open, into an at least partially closed condition. Preferably, the mechanism comprises a linkage system configured to engage the shutter, when open, remote from the end, the linkage system including actuator which is operable from the end. Preferably, the linkage system comprises a drawbar.

Preferably, the actuator is displaceable in a direction towards the end to effect movement of the closure into the at least partially closed condition.

Preferably, the actuator is arranged at a lateral side of the lid.

Preferably, the mechanism is operable to move the closure into a partially closed condition only.

Preferably, closure comprises a shutter. Preferably, the shutter comprises a roller shutter. Alternatively, the shutter may comprise a concertina-type shutter.

In a preferred embodiment of the invention, the lid holds a deodorizing spray dispenser and comprises a mechanism configured to activate the spray dispenser to release deodorizing spray into the receptacle upon opening of the closure.

Preferably, the closure is configured to open in a direction from the end towards an opposite end of the lid.

According to a second aspect of the present invention, there is provided a bin comprising said receptacle and a lid as described above pivotably engaged with the receptacle.

In a preferred embodiment of the invention, the receptacle has a base which is receivable directly against the ground to be frictionally restrained from movement along the ground. Advantageously, the bin can thus be located immovably on the ground, which will generally be preferable over an arrangement in which castor wheels are interposed between the base and the ground.

The invention has application to a wide range of bin receptacle shapes and sizes and is, in particular, applicable to standard 1.5 meter, 3.0 meter and 4.5 meter skip bin receptacles.

BRIEF DESCRIPTION OF THE DRAWINGS

The present invention will now be described, by way of non-limiting example only, with reference to the accompanying drawings, in which.

DETAILED DESCRIPTION OF THE PREFERRED EMBODIMENTS

Figure 2A:
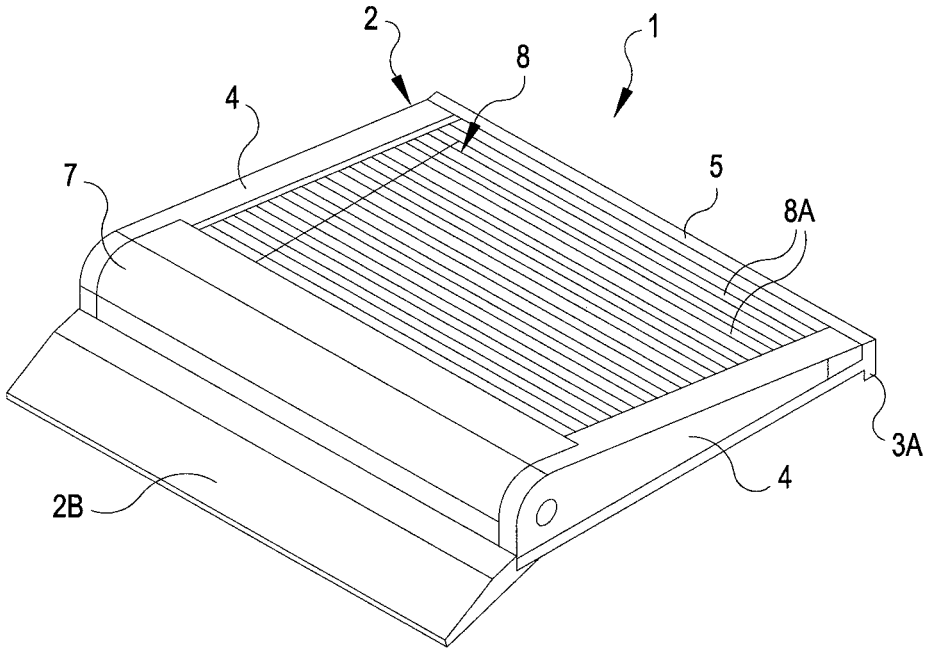
FIG. 2A is a perspective view of a lid for a front-lift bin in accordance with a first embodiment of the present invention.
Figure 2B:
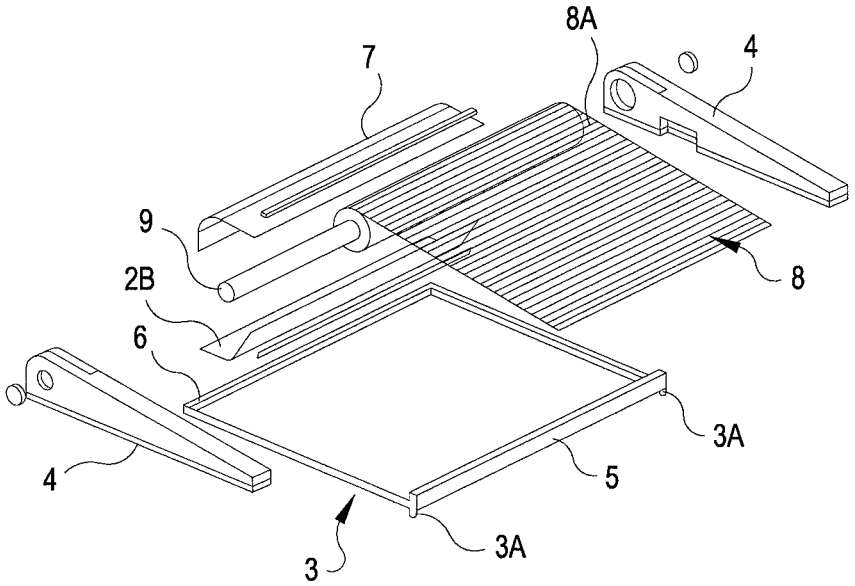
FIG. 2B is an exploded view of the lid of the first embodiment.
Figure 2C:
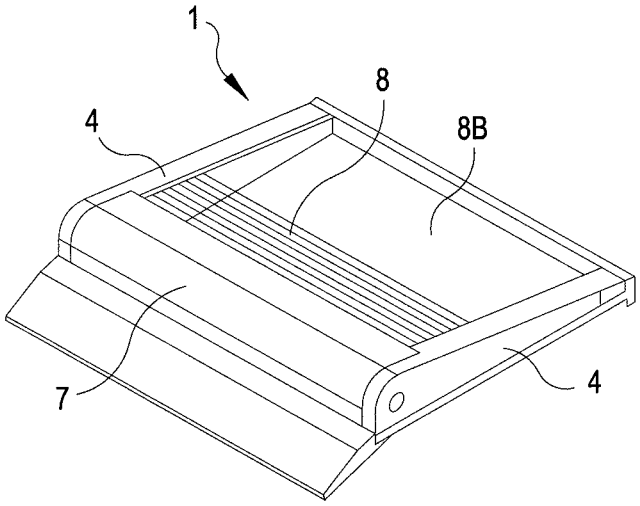
FIGS. 2C and 2D are perspective views showing a closure of the lid in partially and fully open conditions respectively.
Figure 2D:
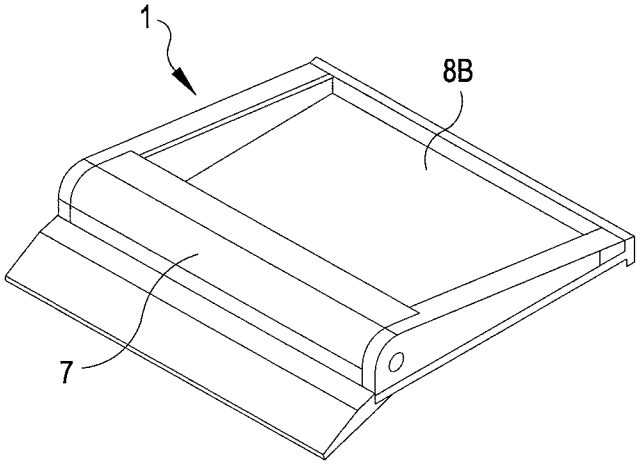

A lid 1 for a front-lift bin according to a first preferred embodiment of the invention is illustrated in FIG. 2A. The lid 1 comprises, referring also to FIG. 2B, a support structure 2 which includes a rectangular base frame 3, opposed arms 4, first 5 and second 6 bracing members defined by frame 3 which extend between proximal ends and distal ends respectively of the arms 4, and a housing 7 extending between distal ends of the arms 4. The lid 1 further comprises a closure in the form of a shutter 8, lateral edges of which are received in tracks 4A defined in the arms 4, and a roller 9 rotatably supported between distal ends of the arms 4. The shutter 8 is connected at one end to the roller 9 and comprises a plurality of parallel rigid slats 8A and flexible interconnections between the slats 8A, whereby the shutter 8, in the closed condition shown in FIG. 2A, when pushed towards the housing 7, imparts rotation to the roller 9 and in so doing is moved, under the guidance of tracks 4A, into an open condition (see FIGS. 2C and 2D), the shutter 8 thus being coiled around the roller 9 in the housing 7. To facilitate opening, the shutter 8 is provided with a handle (not shown) adjacent its forward end (i.e. the end opposite that which is fixed to the roller 9). Opening of the shutter 8 creates an opening 8B through which rubbish can be placed into a front-lift bin receptacle when the lid is received atop that receptacle (as will be described later).

Figure 1A:
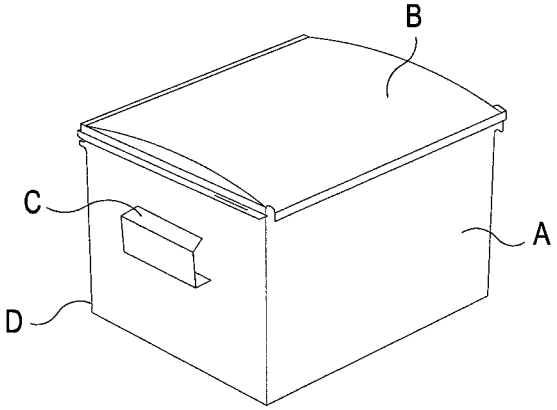
FIG.1A PRIOR ART
FIG. 1A is a rear perspective view of a conventional front-lift bin in a closed condition.
Figure 1B:
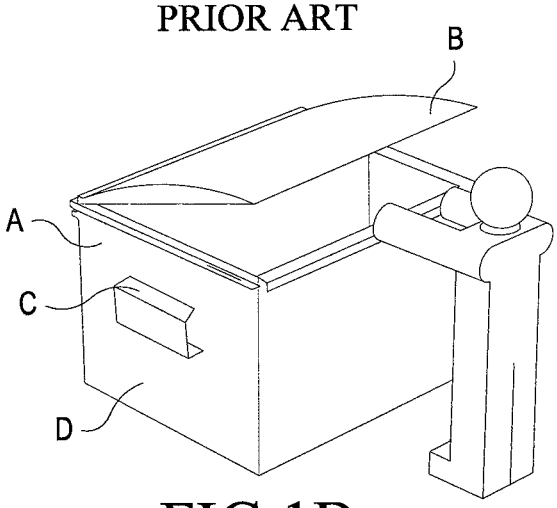
FIG.1B PRIOR ART
FIG. 1B is a front perspective view of the conventional bin in a partially open condition.
Figure 1C:
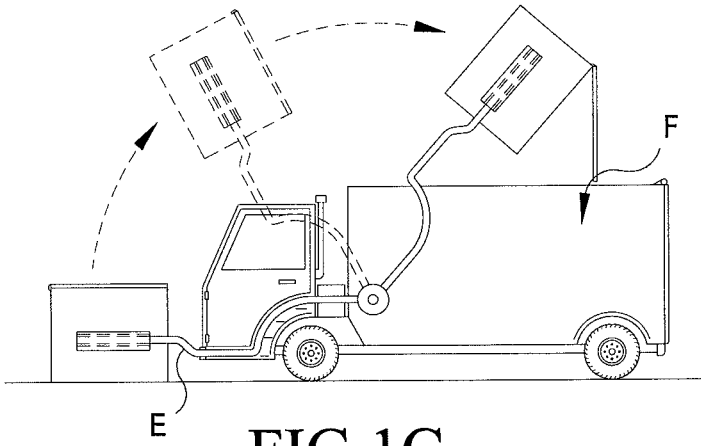
FIG.1C PRIOR ART
FIG. 1C is a schematic view showing inversion and emptying of the conventional bin.
Figure 2E:
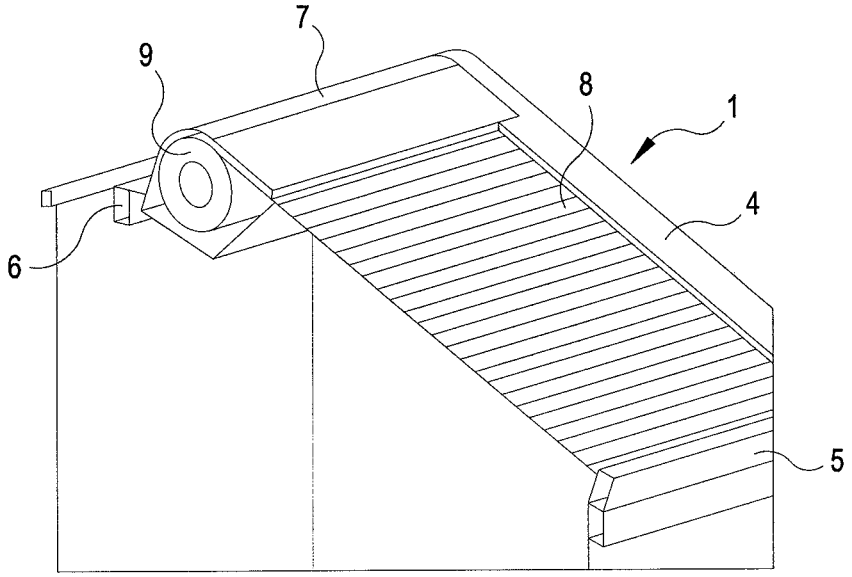
FIGS. 2E and 2F are cut-away perspective views showing details of the lid of the first embodiment.
Figure 2F:
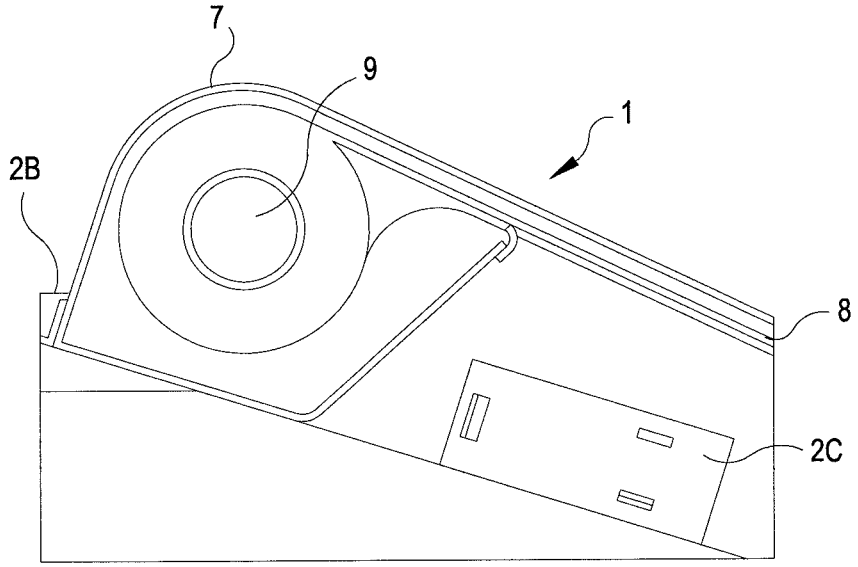
Figure 2G:
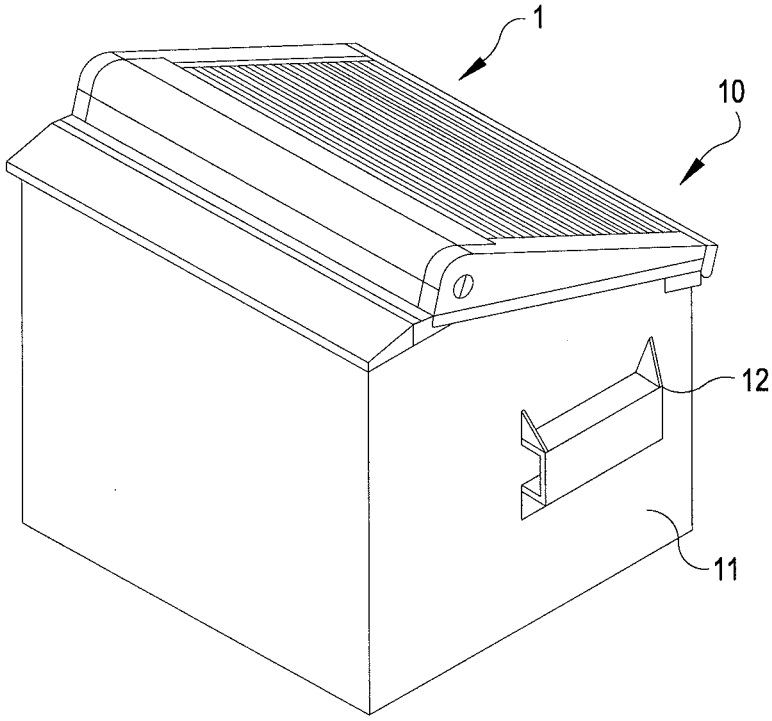
FIGS. 2G and 2H are perspective views and side views, respectively, of a front-lift bin incorporating the lid of the first embodiment.
Figure 2H:
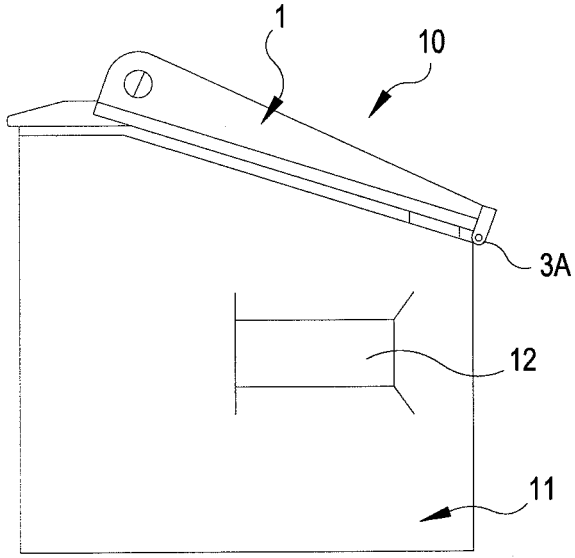

The frame 3 is formed with lugs 3A arranged adjacent the proximal ends of arms 4, each lug having an eye therethrough to receive a respective pin whereby the lid 1 can be pivotally mounted atop an open-topped receptacle 11 to form a front-lift bin 10, as shown in FIGS. 2G and 2H. The receptacle 11 is configured with pockets 12 formed on opposite lateral side walls thereof, the pockets being engageable by tines of a lifting apparatus on a garbage truck, so that the bin 10 can be lifted and inverted to empty its contents into the truck hopper, in the same manner as shown in FIG. 1C.

The lid 1 further comprises a flap 2B located at its distal end, the flap 2B being positioned to seat against an uppermost part of the receptacle rim at the rear of the receptacle, which lies in a flat/level plane, as can be seen in FIGS. 2G and 2H.

The lid 1, sectional views of which are shown in FIGS. 2E and 2F, may be provided with a spray canister containing an agent for treating the air in the receptacle, removably mountable in a recess 2C formed in, one of the arms 4 (see FIG. 2F), and may be configured with a mechanism (not shown) which triggers operation of the canister such that a quantity of spray, containing the agent, is automatically output from it when the shutter 8 is opened. The agent may comprise, for example, a deodorizing agent and/or disinfecting agent. In another embodiment, the mechanism may be configured to trigger operation of the canister when the closure is, instead or additionally, closed.

Advantageously, the provision of the closure, which opens from the same side of the receptacle 11 as that at which the hinged interconnection between the lid 1 and receptacle 10 is located, enables disposal of rubbish into the bin to be carried out at one side of the bin and garbage truck access to take place at the opposite side of the bin. The bin thus does not need to be rotated through 180° on the ground either after it is deployed by the truck or before it is re-engaged by the truck. Accordingly, castor wheels, which can create a risk of the bin inadvertently rolling away from its intended location when on an inclined surface or in heavy winds and an increased likelihood of the bin being improperly relocated by vandals or troublemakers, need not be, and are not, provided on the base of the bin.

Moreover, the lid configuration reduces hazards and difficulties associated with emptying the bin 10 when overfilled because the lid 1 can remain in the closed position, i.e., with its support structure 2 seated against the perimeter of the receptacle top when rubbish protrudes through the opening defined through the lid 1 when the shutter 8 is open, whereby the support structure 2, particularly the arrangement of arms 4 and housing 7, provides some lateral/horizontal restraint to the rubbish at or near the top of the bin 1.

The shutter 8, in its closed condition, may be locked with respect to the support structure 2, for example by means of a padlock (not shown) engageable with the cross member 5 and the forward end of the shutter 8.

In the present embodiment, as can be seen in FIGS. 2E to 2H, the plane which the shutter 8 occupies in its closed condition, when the lid 1 is closed, is downwardly inclined, whereby the shutter 8, after being opened and with the lid 1 in the closed position, may be, advantageously, self-closing under the action of gravity.

Also advantageous is that the shutter 8, because it does not need to be pivoted against gravity to be opened, is easily openable, and need not be propped open, in the same way as are lids of conventional front-lift bins, to facilitate disposal of rubbish into the bin, reducing the risk of injury associated with gaining access to the bin interior and eliminating the risk of injury to a person's fingers in the event of sudden inadvertent closure of the lid under the action of gravity.

In the following description and drawings of each further embodiment, reference numerals referring to features which correspond to features of the respective immediately preceding embodiment will be greater in value by 20.

Figure 3A:
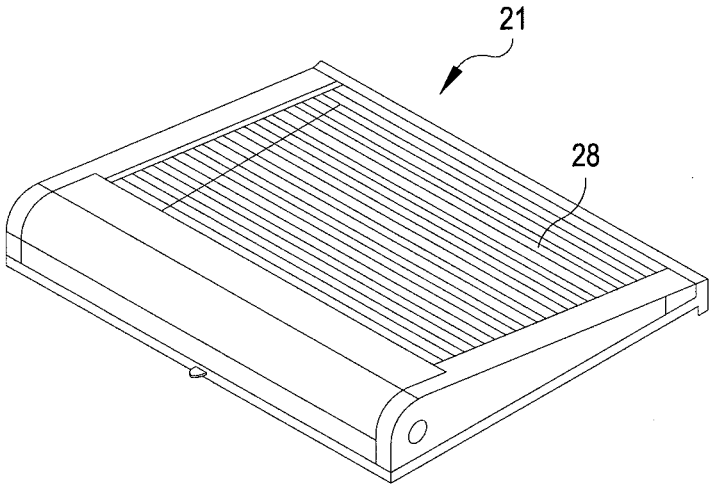
FIGS. 3A and 3B are perspective views and side views, respectively, of a lid for a front-lift bin in accordance with a second embodiment of the present invention.
Figure 3B:
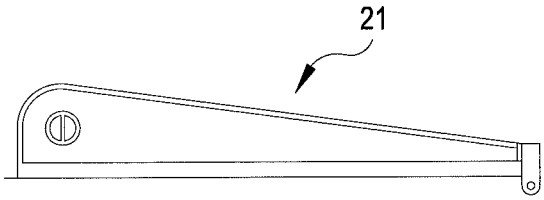
Figure 3C:
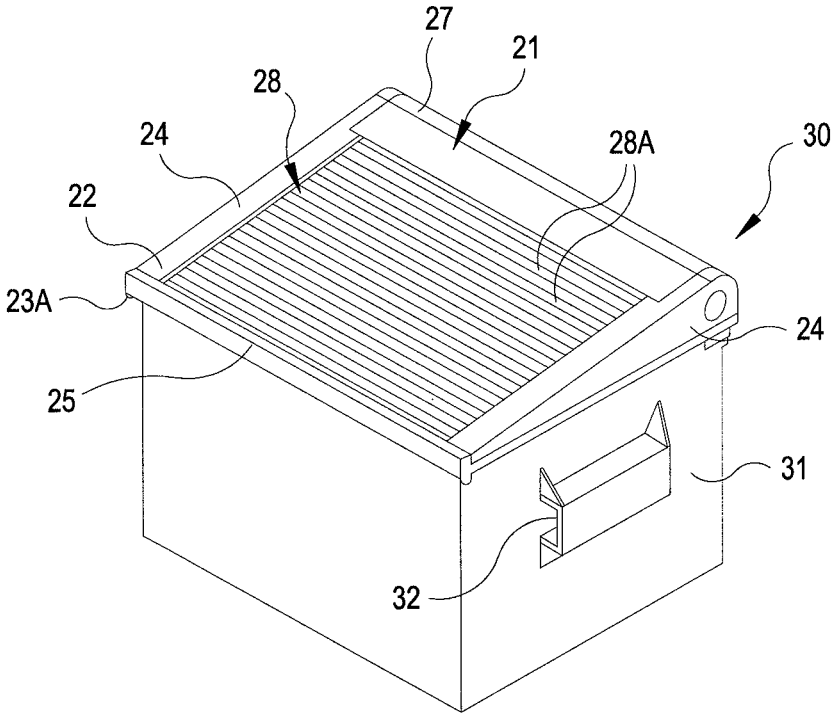
FIGS. 3C and 3D are perspective views and side views, respectively, of a front-lift bin incorporating the lid of the second embodiment.
Figure 3D:
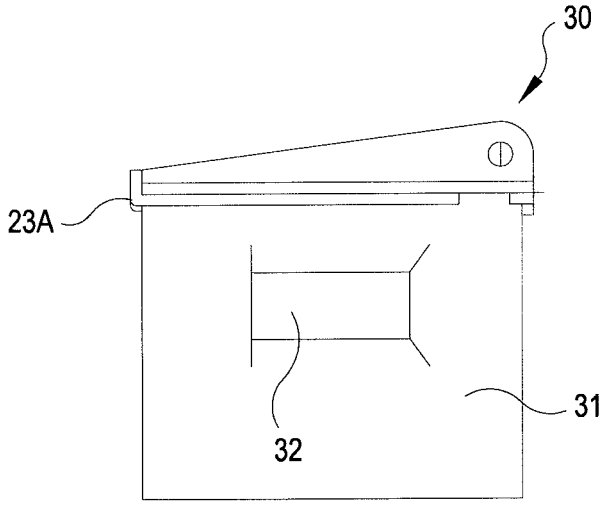

A lid 21 according to a second preferred embodiment of the invention is illustrated in FIGS. 3A and 3B, and a bin 30 incorporating it is illustrated in FIGS. 3C and 3D. The lid 21 is essentially the same as that of the first embodiment, though is configured for use with a receptacle 31 having a completely flat (level) top instead of a sloped top. As will be clear from FIGS. 3C and 3D, the plane occupied by the shutter 28 when the lid 1 is closed is downwardly inclined, whereby the shutter 28, again, may be self-closing under the action of gravity. In this embodiment, the distal end of the lid 21 does not comprise a flap, since the rectangular base frame can seat against the receptacle rim at that end.

Again, the shutter 28 is provided with a handle (not shown) corresponding to that with which shutter 8 is provided.

Figure 4A:
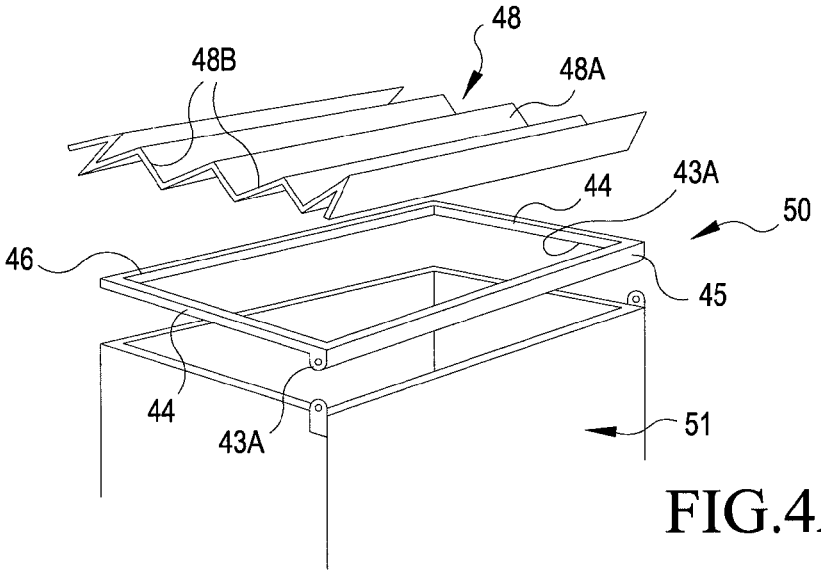
FIGS. 4A to 4C are perspective views of a front-lift bin incorporating a lid according to a third embodiment of the present invention.
Figure 4B:
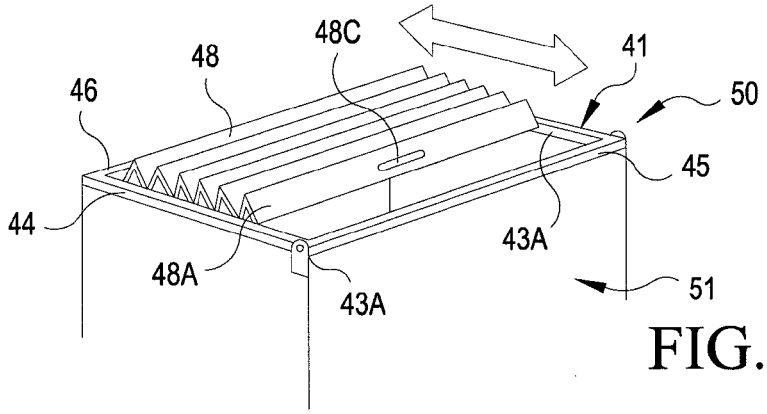
Figure 4C:
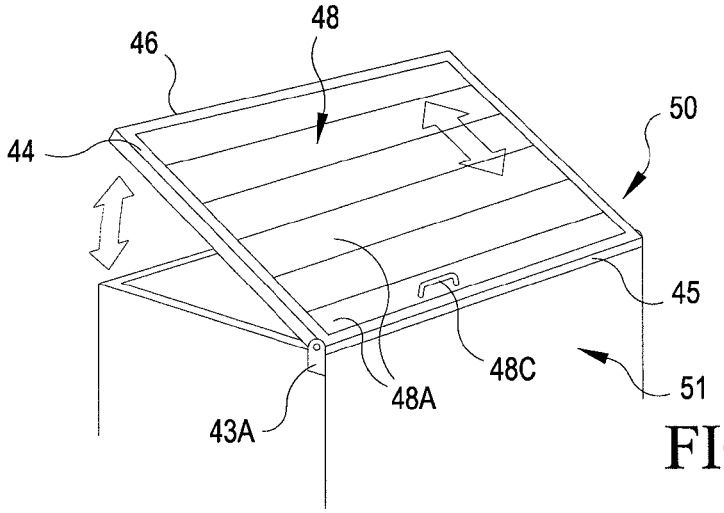

A bin 50 incorporating a lid 41 according to a third embodiment of the present invention is illustrated in FIGS. 4A to 4C. In this embodiment, the closure is not a roller door-type shutter but instead a concertina-type shutter 48 formed from polycarbonate, the shutter 48 being formed with rigid slats 48A interconnected by hinges, which may be living hinges and may be integrally formed therewith. Provided at both ends of alternate ones of the living hinges are projections 48B, which may be integrally formed with those ends or separately formed and fixed thereto, the projections 48B being received in tracks 43A of arms 44 (which arms in this embodiment are defined solely by members of the base frame 42 interconnecting the bracing cross-members 45 and 46), whereby the shutter 48 is moveably retained in frame 42. The rear end of the shutter 48 is fixed to cross member 46 at that end.

The shutter 48 has a handle 48C which, consistent with the handles in the preceding embodiments, can be grasped by a person standing at the front side of the bin 50 (i.e., where the hinge lugs 44A are located) for opening and closing of the shutter 48.

The opening and closing movement of the shutter 48, like that of the roller shutter, is in a direction across the opening defined through the lid. Advantageously, the shutter 48 also is easily openable and need not be propped open for disposal of rubbish into the bin.

Figure 5:
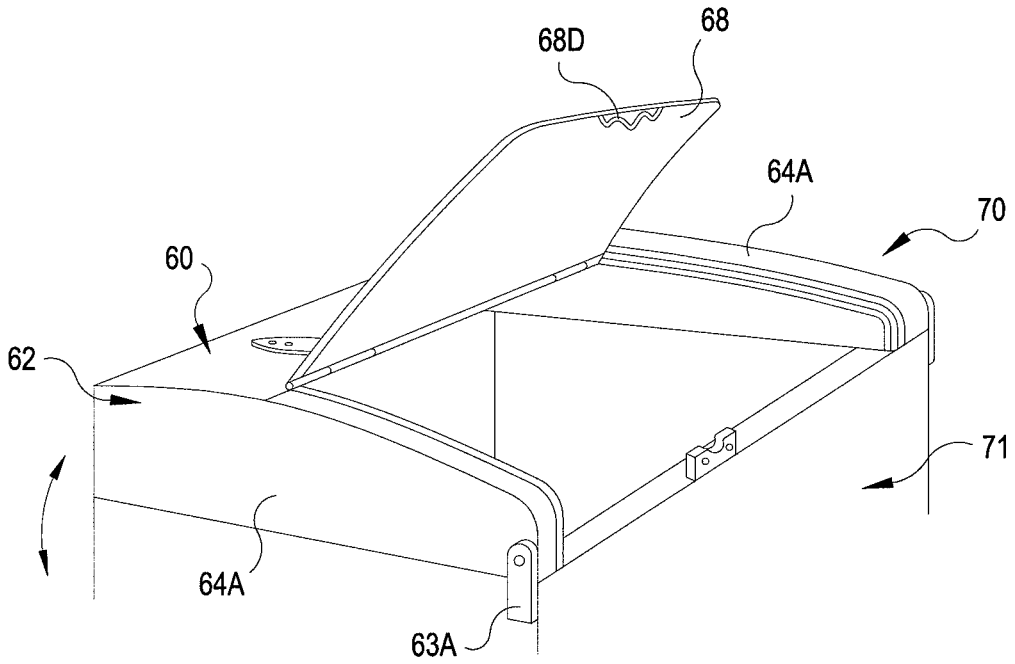
FIG. 5 is a perspective view of a part of a front-lift bin incorporating a lid according to a fourth embodiment of the present invention.

A bin 70 incorporating a lid 61 according to a fourth embodiment of the present invention is illustrated in FIG. 5. In this embodiment, the closure comprises a shutter 68 which is hingedly mounted to the support structure 62 to be pivotable between a closed condition, in which its distal end is received adjacent the proximal end of the support structure 62, and an open position, in which it permits access to the interior of the receptacle 71 for rubbish disposal. The lid 61 is also provided with a handle at its distal end, and may be swung open so as to rest against the support structure 62 at the distal (free) end of the lid 61. The lid 61 further comprises a lock 68D by means of which the shutter 68 can be locked, at its distal end, in the closed position.

Figure 6:
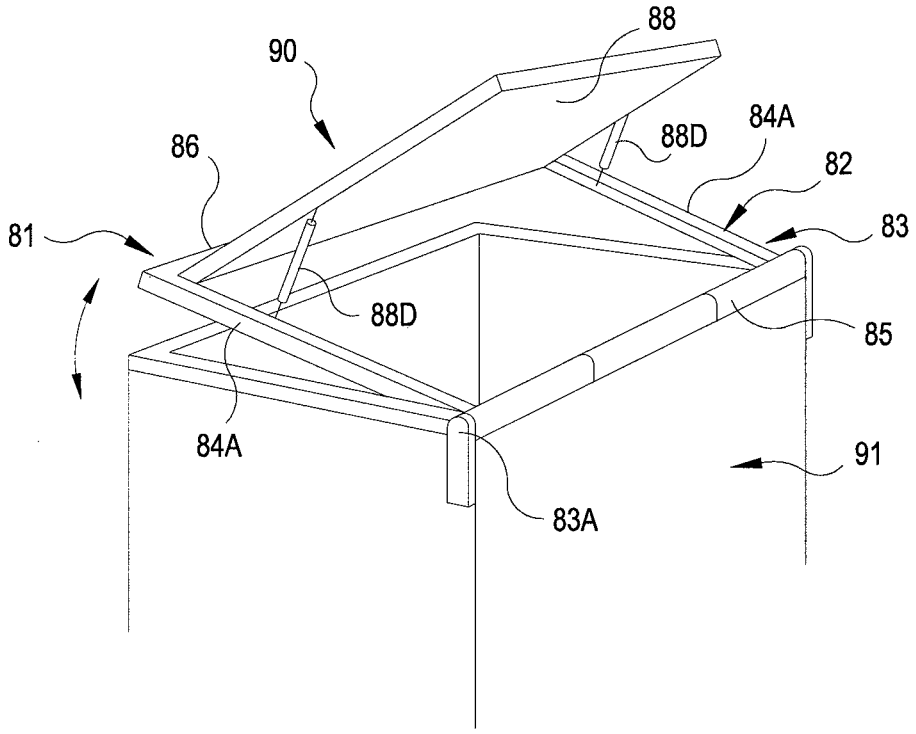
FIG. 6 is a perspective view of a front-lift bin incorporating a lid according to a fifth embodiment of the present invention.

A bin 90 incorporating a lid 81 according to a fifth embodiment of the present invention is illustrated in FIG. 6. In this embodiment, the support structure 82 is defined substantially solely by the base frame 83, and the closure, like that in the fourth embodiment, is hingedly mounted to the support structure 82. Specifically, the proximal end the lid 81 is hingedly connected to the cross member 86 to be pivotable between a closed condition, in which its distal end is received adjacent the proximal end of the support structure 82, and an open position as can be seen in FIG. 6. In this embodiment, the lid 81 further comprises gas struts 88D, each of which is pivotally connected at a first end to a respective arm 84 and at a second end to the shutter panel 88, the gas struts 88D exerting an opening bias against the shutter 88 to facilitate opening of it. Again, a handle (not shown) is provided at the distal end of the shutter to facilitate opening, and the lid 81 may further comprise a lock whereby the shutter 88 can be locked to the support structure in its closed position.

Each of the closures in the lids 61,81, unlike that in each of the other illustrated embodiments, does not move across/in the plane of the opening defined through the respective lid but instead pivots towards and away from the opening.

Figure 7A:
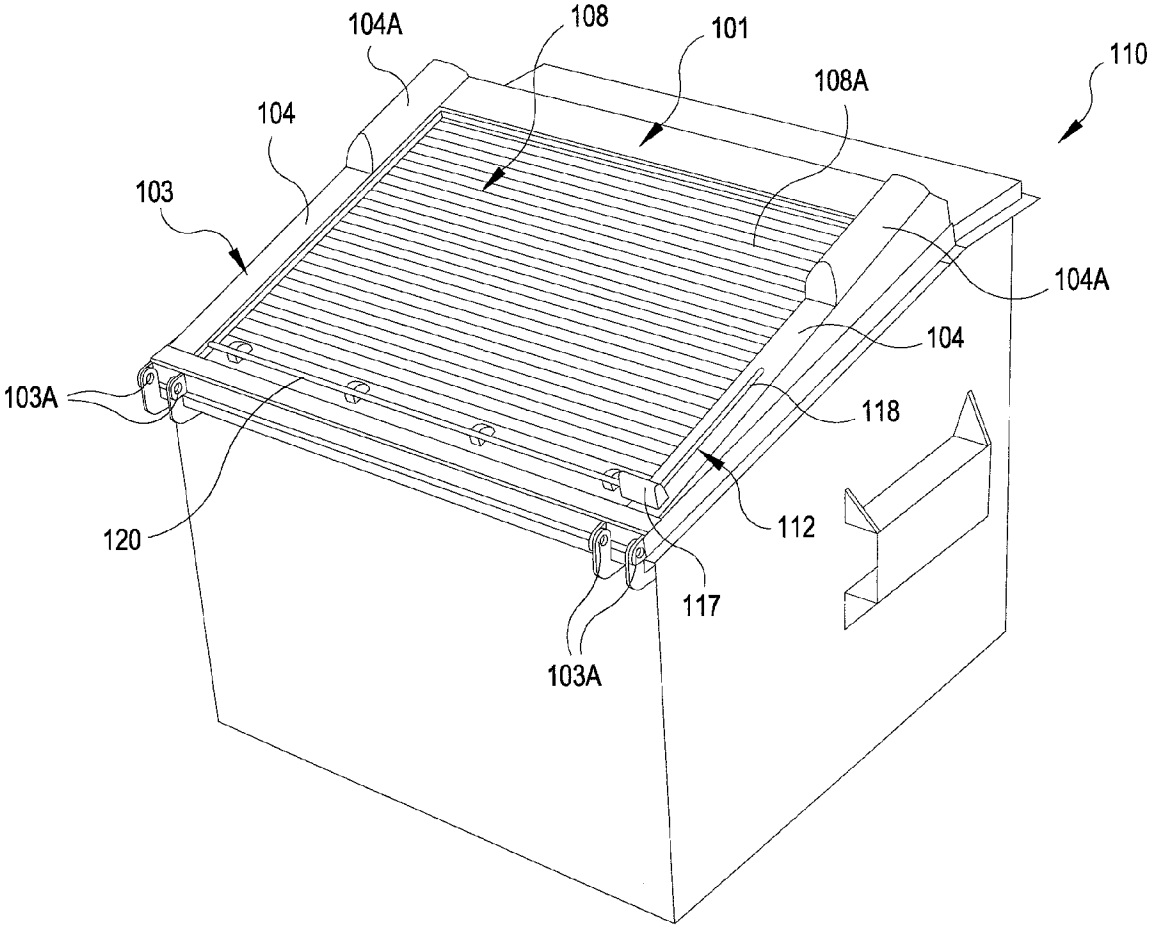
FIGS. 7A to 7C are perspective views of a front-lift bin incorporating a lid according to sixth embodiment of the present invention.
Figure 7B:
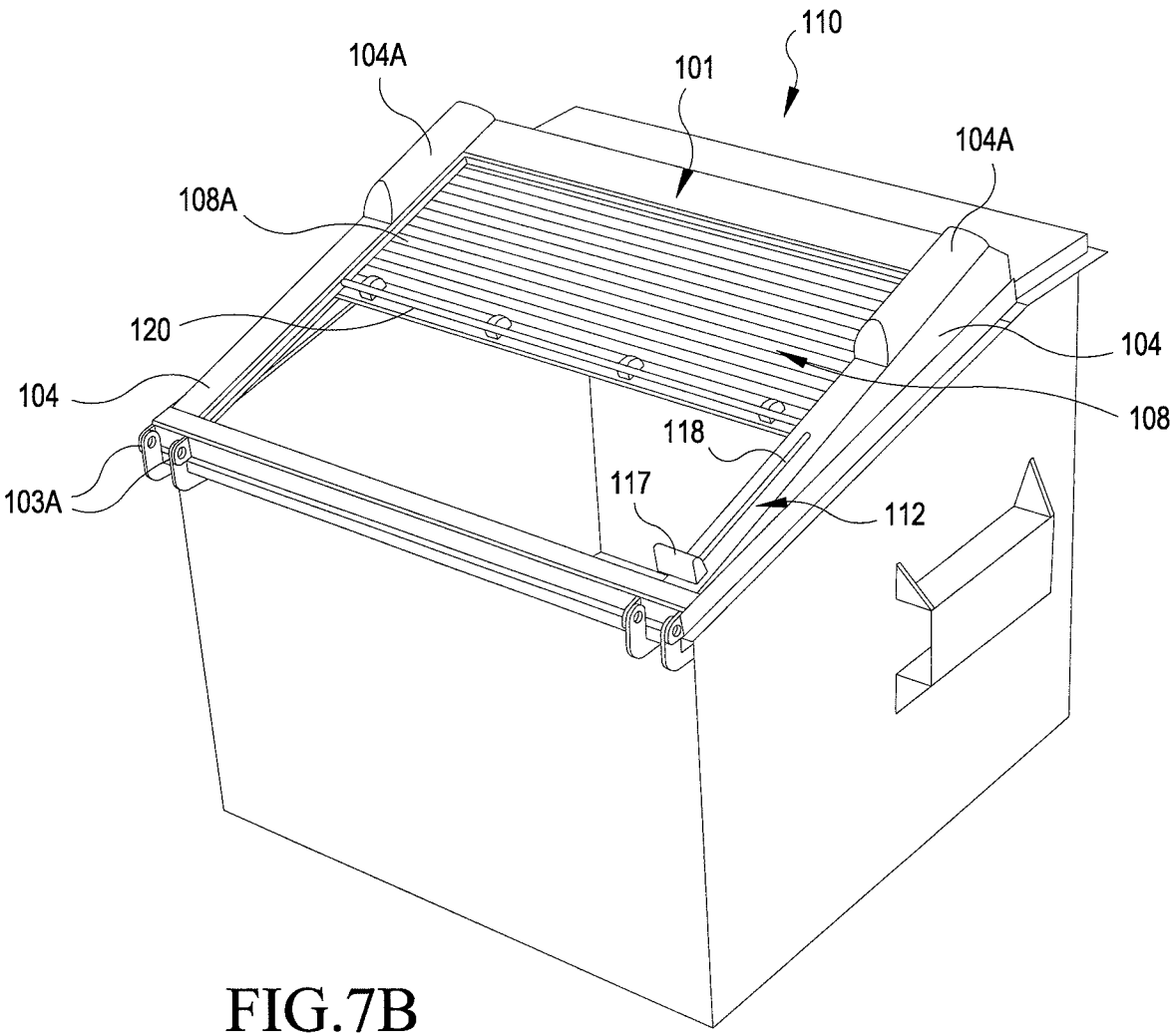
Figure 7C:
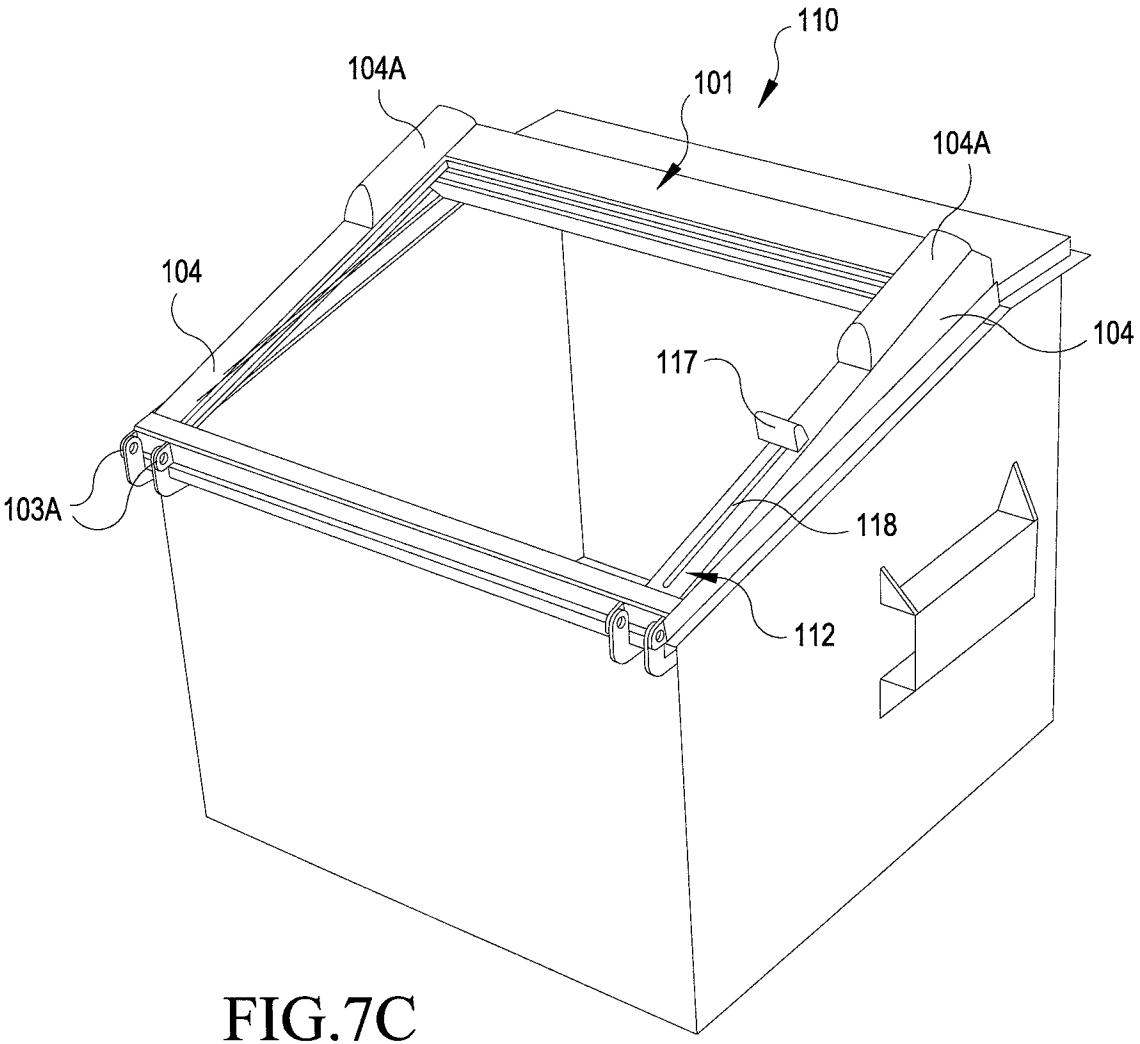
Figure 7D:
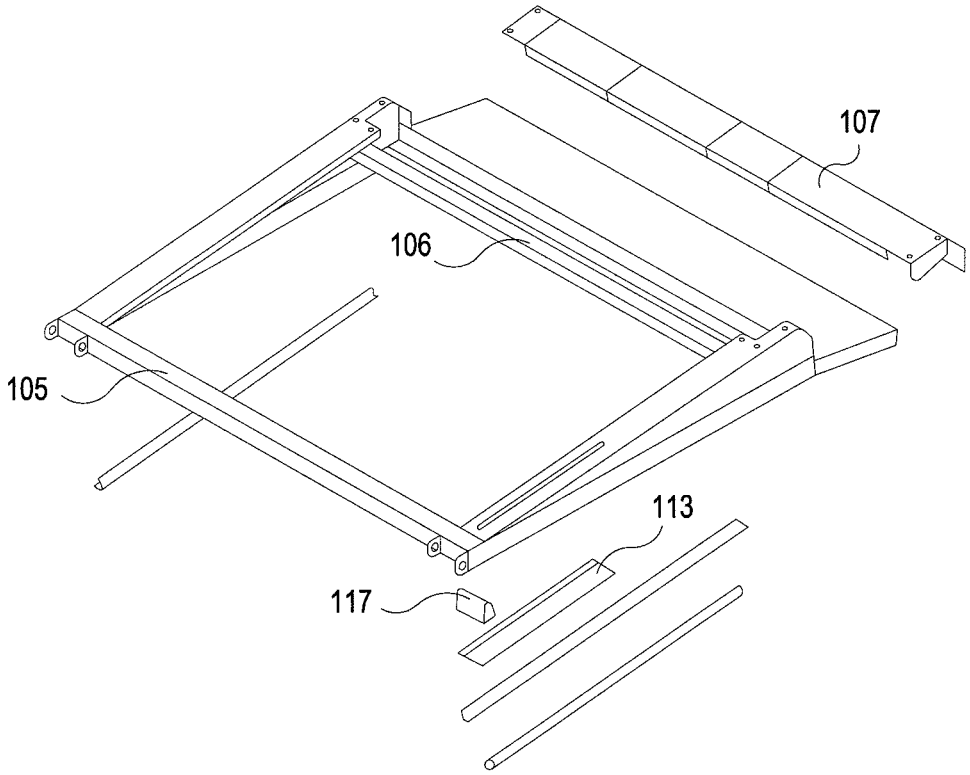
FIG. 7D is a partially exploded perspective view showing components of the lid of the sixth embodiment.
Figure 7E:
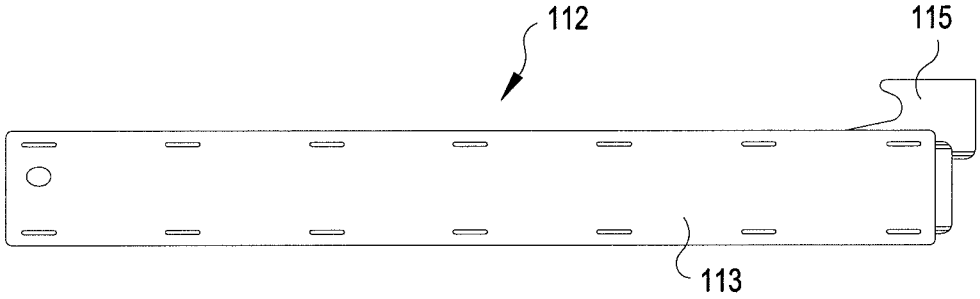
FIGS. 7E to 7G show a connector plate and latch assembly which form part of a closure mechanism in the lid of the sixth embodiment.
Figure 7F:
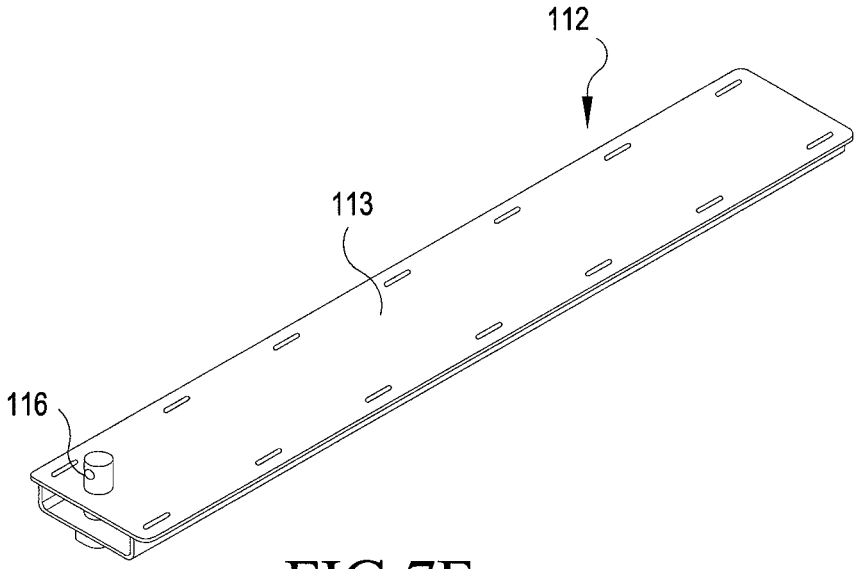
Figure 7G:
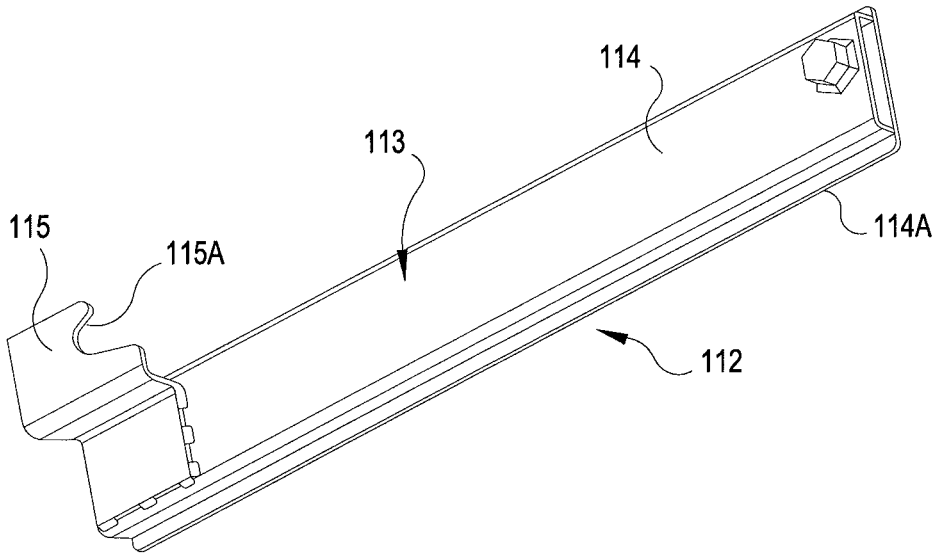

A bin 110 incorporating a lid 101 according to a sixth embodiment of the present invention is illustrated in FIGS. 7A to 7C. The lid 101 is similar to the lid 1 according to the first embodiment, comprising a support structure which includes a rectangular base frame, opposed arms 104, first 105 and second 106 bracing members (see FIG. 7D) defined by frame 103, a housing 107, a shutter 108 the lateral edges which are received in tracks 104A (see FIGS. 7H and 7I), comprising a plurality of parallel rigid slats 108A and flexible interconnections between the slats 108A, and a roller (not shown) which is the same as that shown in FIG. 2B but is rotationally biased, such as by a torsional spring arrangement in a barrel of the roller, in an opening direction, whereby the action of gravity on the shutter 108 (which is downwardly inclined when closed) is countered, facilitating opening of the shutter 108 and enabling it to remain in whichever position, between the open and closed positions, it occupies after operation.

It will be appreciated that the previously described embodiments incorporating a roller maybe modified such that the roller is similarly biased, without departure from the invention.

The lid 101 further comprises bump rubbers 104A arranged on the arms 104 to protect the lid 101 from impact against the hopper on the truck when the bin 110 is emptied.

Figure 7H:
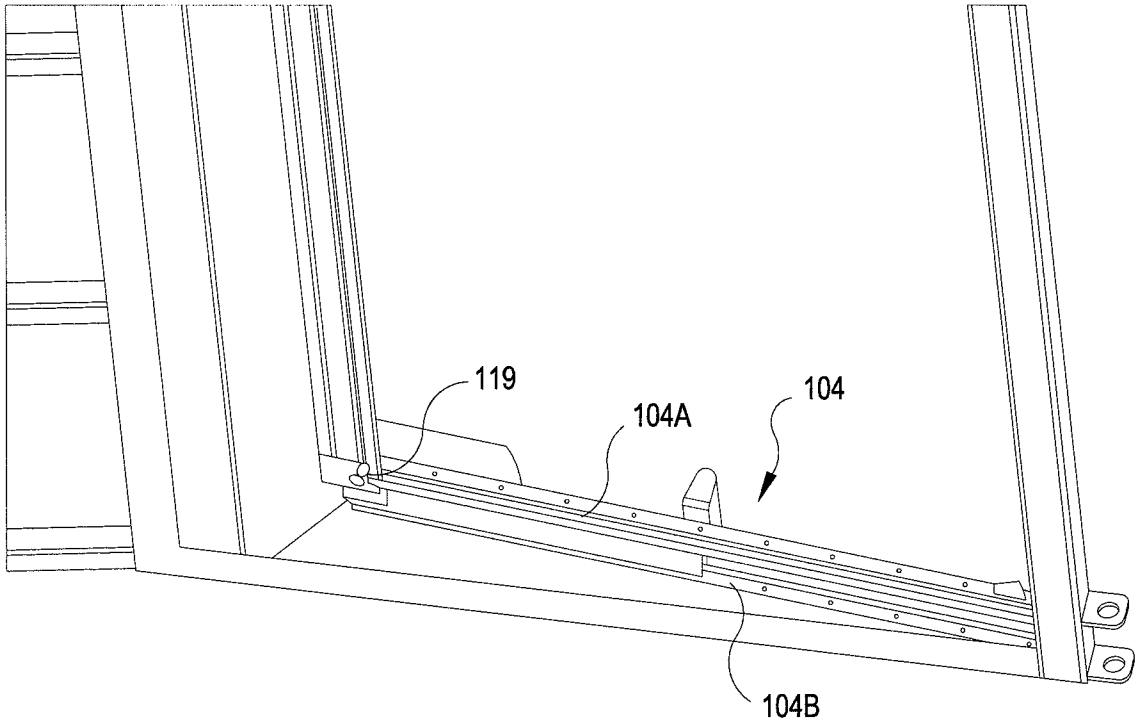
FIGS. 7H to 7I show the manner in which the assembly of FIGS. 7E to 7G engages a closure of the lid to enable the lid to be closed.
Figure 7I:
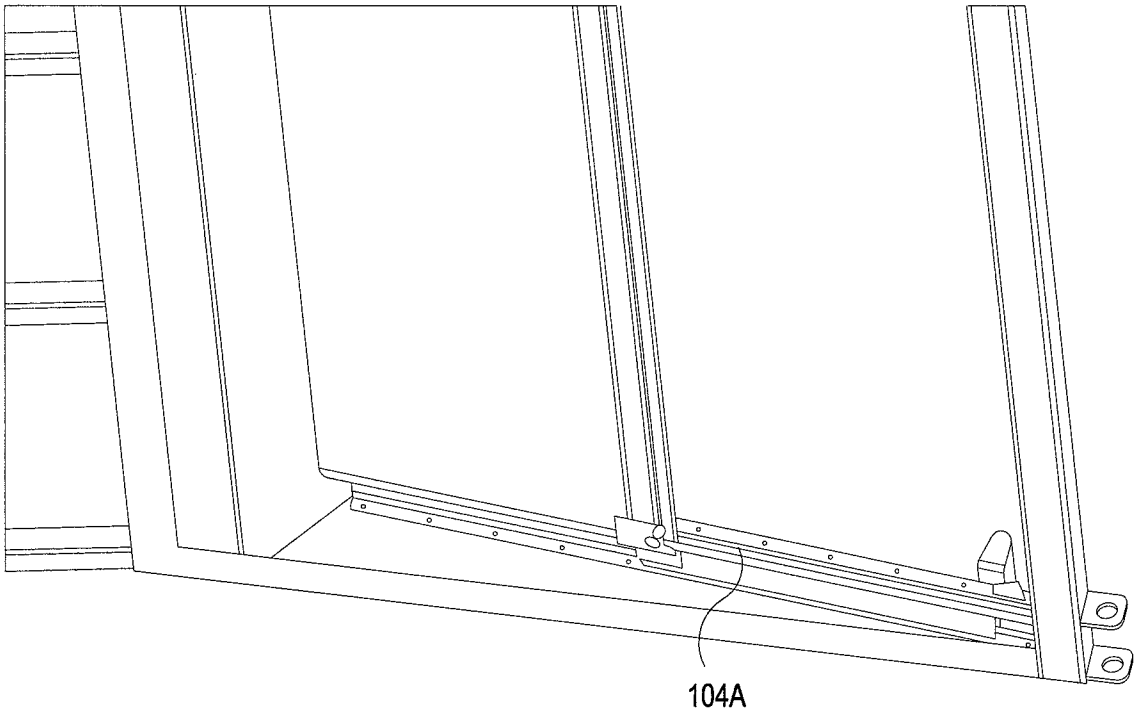

To facilitate closure of the shutter 108, the lid 101 comprises a closure mechanism 112 which includes a draw bar 113 having a connector arm in the form of an elongate rib member 114, a latch 115, which is bent from plate and formed with a hook portion 115A, provided on an underside of the rib member 114 at a far end thereof, a pin 116 projecting upwardly from the rib member 114 at a near end thereof and a handle 117 (see FIGS. 7A to 7D) which is attached to the pin 116. The rib member 114 is received within one of the arms 104—in the present case the right arm—of the lid 101 and is configured with a lip 114A which overlappingly engages a lip member 104B extending within and along the length of the right arm 104 and defines part of a track along which the connector arm 114 can slide, the other part of the track being defined by a slot 118 (see FIGS. 7A to 7C) formed through a top wall of the right arm 104, through which the pin 116 projects so as to be constrained to move axially along the slot 118, thereby locating the drawbar 113 relative to the slot 118, the handle 117 being arranged on an upper portion of the pin outside the slot 118. As can be seen in FIGS. 7H and 7I, the hook portion 115A of latch 115 engages a downwardly projecting lug or pin 119 provided on the shutter 108 adjacent the forward edge thereof.

The mechanism 112 is configured such that, when the shutter 108 assumes its open condition, shown in FIG. 7C, the draw bar 113 occupies a distal section of the right arm 104, having been drawn into that section, along its track, by the pin 119 (engaging the hook portion 115A) during opening of the shutter 108, whereby handle 117 is positioned at a far end of the slot 118. To close the lid 101, a person standing at the front end of the bin 110 grasps the handle 117 and draws it along the slot 118 towards that end, whereby the latch 115 draws the pin 119 and thus the shutter 108 in a closing direction. Once the handle 117 has been drawn the full length of the slot 118, whereby the draw bar 113 occupies a proximal section of the right arm 104, the shutter 108 assumes a partially closed condition, as shown in FIG. 7B. Advantageously, when the shutter 108 is fully open, the handle 117, unlike the forward edge of the shutter 108, is within reach of a person standing at the front of the bin 110, and thus enables the person to draw the shutter 108 into the half-closed position shown in FIG. 7B whilst he or she is standing at that position, eliminating any need for the person to walk along the side of the bin to grasp the shutter 108.

With the lid 101 is in the condition shown in FIG. 7B, the person may grasp a handlebar 120, which is fixed to the shutter 108 at its front end and extends substantially the width of the shutter 108, and pull the handlebar 120 to draw the shutter 108 towards the proximal end of the lid 101, whereupon the latch 115 disengages from the lug/pin 119, as permitted by the mouth of the hook portion 115A opening in the direction towards the proximal end, whereby the shutter 108 can be fully closed, as shown in FIG. 7A. Clips (not shown) are provided at the proximal end of the lid 101 to engage the handlebar 120 and thus retain the shutter 108 closed. A key lock (also not shown) may be provided in the lid 101 to lock the shutter 108 in the closed position.

In another embodiment, the closure mechanism 112 may be provided on the other arm 104, whereby that mechanism is operable by the person's left hand instead of the person's right hand, or a closure mechanism 112 may be provided on both arms 104 whereby both left-hand and right-hand operation is permitted.

The lid 101 may be provided with a deodorizing spray canister, recess and canister-operating mechanism as previously described with reference to FIGS. 2E and 2F,as may the lid of any of the other embodiments.

It will be clear that, in each of the embodiments, the lid comprises a closure which is openable from the end at which the lid is pivotally mounted to the receptacle, by a person standing at that end.

It will be appreciated that the lid according to each embodiment may be provided as part of a front-lift bin or retro-fitted to an existing skip to form a front-lift bin.

Many modifications will be apparent to those skilled in the art without departing from the scope of the present invention.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A lid for a bin, an end of the lid being configured for pivotal engagement with an open-top of the bin whereby the lid is pivotable between (i) an open position in which it is substantially clear of the open top to permit emptying of the bin by inversion of the bin, and (ii) a closed position, in which the lid covers the open top, the lid comprising a closure which is movable across an opening defined through the lid, the closure movable between (i) an open condition, in which it permits waste to be placed into the receptacle through the opening at the end of the lid being configured for pivotal engagement, and (ii) a closed condition, in which the lid covers the opening, wherein the closure is openable from the end where the lid is configured for pivotal engagement;

wherein the closure comprises a shutter; optionally wherein the shutter comprises a roller shutter.

2. A lid according to claim 1, wherein the closure is configured to open from the end.

3. A lid according to claim 1, configured such that, when the lid is used in the bin, the closure, once opened, can remain open.

4. A lid according to claim 1, comprising retaining means for releasably retaining the closure in the closed condition.

5. A lid according to claim 4, wherein the retaining means is operable at the end.

6. A lid according to claim 1, including a support configured for engagement, at the end of the lid, with the receptacle, the support being configured with said opening.

7. A lid according to claim 6, wherein the closure is moveable, supported by and relative to the support, across the opening, between the open and closed conditions.

8. A lid according to claim 6, wherein the support comprises a pair of opposed arms configured to extend along the sides of the receptacle adjacent said top when the lid is in the closed position and being arranged to support the closure in the closed condition.

9. A lid according to claim 8, wherein the closure is slidably movable along the arms to be opened or closed.

10. A bin comprising a receptacle and a lid pivotably engaged with the receptacle;

wherein the lid comprises an end of the lid being configured for pivotal engagement with an open-top of the bin whereby the lid is pivotable between (i) an open position in which it is substantially clear of the open top to permit emptying of the bin by inversion of the bin, and (ii) a closed position, in which the lid covers the open top, the lid comprising a closure which is movable across an opening defined through the lid, the closure movable between (i) an open condition, in which it permits waste to be placed into the receptacle through the opening at the end of the lid being configured for pivotal engagement, and (ii) a closed condition, in which the lid covers the opening, wherein the closure is openable from the end where the lid is configured for pivotal engagement; and wherein the bin is a front-lift bin, dumpster or front loader container.

11. A bin according to claim 10, wherein the receptacle has a base which is receivable directly against the ground to be frictionally restrained from movement along the ground.

12. A lid according to claim 1, being for a front-lift bin, dumpster or front loader container.

* * * * *